US005295269A

United States Patent [19]

Ballard

[11] Patent Number: 5,295,269

[45] Date of Patent: Mar. 22, 1994

[54] PORTABLE HAND WRAP

[76] Inventor: Willie L. Ballard, 5616 Old Mission Rd., Chattanooga, Tenn. 37411

[21] Appl. No.: 827,619

[22] Filed: Jul. 20, 1992

[51] Int. Cl.[5] ..... A41D 13/10

[52] U.S. Cl. ..... 2/18; 2/161.1; 2/917

[58] Field of Search ..... 2/16, 18, 20, 21, 161 A, 2/DIG. 6

[56] References Cited

U.S. PATENT DOCUMENTS

| | | | |
|---|---|---|---|
| 1,627,382 | 5/1927 | Golomb | 2/18 |
| 1,706,503 | 3/1929 | Travers | 2/18 |
| 2,567,489 | 9/1951 | Lewis | 2/20 |
| 4,287,609 | 9/1981 | Amadeo | 2/16 |
| 4,400,829 | 8/1983 | Willis | 2/16 |

FOREIGN PATENT DOCUMENTS

| | | | |
|---|---|---|---|
| 0008340 | 1/1977 | Japan | 2/16 |

*Primary Examiner*—Clifford D. Crowder
*Assistant Examiner*—Michael A. Neas

[57] ABSTRACT

An all purpose hand protection glove is formed of padded casing for fitting across the back of the hand, fingers and wrist of the user. A thin resilient hand pad is contained in the casing on the back of the hand and finger and wrist portion of the glove for fitting over the user's right or left hand. A hook and loop fastener strip is attached to the side of the wrist portion of the pad so that 85 inches of handwrap, included with the glove, may be attached to the hook and loop fastener strip, at the option of the user, to use in wrapping the thumb and stabalizing the wrist of the user. Two hinge points are formed, one between the hand pad and finger pad and the other between the hand pad and wrist pad to permit flexing of the fingers and wrist. The pads over the fingers are individually stitched to provide protection for each digit and increase the flexibility of the fingers. Four individual flexible elastic loops, through which the fingers insert, extend from the palm side of the casing. An elastic band is attached to the wrist portion of the glove (palmside) to secure the glove at the palm. A hook and loop fastener strap is provided at the wrist to facilitate individual adjustment. The palm and thumb are not padded and are unrestricted.

6 Claims, 4 Drawing Sheets

PORTABLE HAND WRAP

The present invention relates to a protective glove for athletes of all sports. Injuries are occuring with increasing frequency in both amateur and professional sports. The hands, in particular, are very vulnerable to injury.

BACKGROUND OF INVENTION

Hand protection has always been needed in professional boxing and martial arts. Because the hands, fingers, and knuckles are constantly used with the force behind each punch that is thrown, without proper hand padding protection, hands become damaged with such injuries as a complete break, fractures, ligament damage. All of these injuries can result in swelling of the hands. Out of these situations the portable handwrap was born, in order to address these overidding needs in the sport.

One hundred seventy (170) inches of handwrap, which constitutes fourteen (14) feet, is used by golden gloves and amatuer boxers. Professional boxers and trainers spend 45 minutes to 1 hour wrapping a fighter's hands and knuckles with gauze to protect his hands from breaks and fractures. These injuries are very common in today's violent hand to hand combat.

Because of the violent society we live in today, more men, women, and children are engaging in hand to hand combat today.

Within the last 100 years, there has not been an invention such as the portable handwrap which provided a simple, lightweight, durable, and unrestrictive glove that offered protection for hands from any damage.

The portable handwrap is the solution to today's hand protection needs. Within 10 seconds, the glove can be secured to the fighter's hands. The fighter is then prepared for speed bag work, heavy bag work, or actual sparring.

The portable handwrap eliminates the time consuming task of wrapping a fighter's hands. The glove easily slips on and off, it offers the needed protection, and it is easy, simple, and comfortable.

The portable handwrap incorporates four individually padded finger pads, one for each finger digit, a padded knuckle guard, padded back-of-hand, and padded wrist. This protection is needed because punches are thrown with such force that it could easily damage a hand when a straight punch is thrown, as in boxing, or a punch with the back-of-the-hand, as in martial arts.

The wrist area includes an optional hook and loop fastener attachment which, at the fighter's discretion, can be used to attach 85 inches of handwrap. The fighter uses the 85 inches of handwrap in order to stabilize the wrist and the thumb area and provide added protection. The fighter may apply the handwrap to the desired level of security.

The portable handwrap also incorporates a revolutionary double-hinged seam design to provide complete flexibility for the hands, fingers, and wrists, enough so that the user can easily make a tight fist. The glove, as a result, acts as an extension of the hand itself.

The portable handwrap also incorporates 4 finger holders to secure the fingers to the glove and a single strip secures the palm of the hand to the glove. These serve to fasten the glove to the top of the hand, leaving the palm of the hand free and unrestricted. This construction also makes the glove lightweight and portable.

SUMMARY OF THE INVENTION

The deficiences of the prior art are overcome and the requirements for an effective protective glove for all sports are met by the present invention which provides a glove of tough flexible material with a pad extending across the fingers, back of the hand and wrist, leaving the palm and thumb free from padding and unrestricted, and covering the fingers up to the first knuckle joint. The padding at the fingers is individually stitched for each finger to provide individual protection and flexibility for each digit. Four individual elastic loops extend from the palm side of the finger pads. The addition of a hinged seam at the knuckles, as well as the hinged seam at the wrist, permits the hand to flex and form a first. The addition of an elastic band at the palm of the hand (along with the hook and loop fastener at the wrist portion of the hand) permits quick adjustment or removal of the glove. Additionally, a hook and loop fastener strip is attached at the sides of the wrist portion of the glove, just above the wrist, to allow the optional attachment of the 85 inches of handwrap to stabalize the thumb and wrist, if preferred.

DESCRIPTION OF THE DRAWINGS

FIGS. 1 and 2 are shown with the wrist strap opened and the 85 inches of thumb stabalizing handwrap attached.

Both FIGS. 3 and 4 are shown with the palm side of the glove, with the elastic band over the palm, the hook and loop fastener strip sewn to wrist portion of the glove (for attaching the 85 inches of handwrap) and the wrist strap, with the hook and loop fastener attachment, opened.

DETAILED DESCRIPTION OF THE INVENTION

Figure 1:
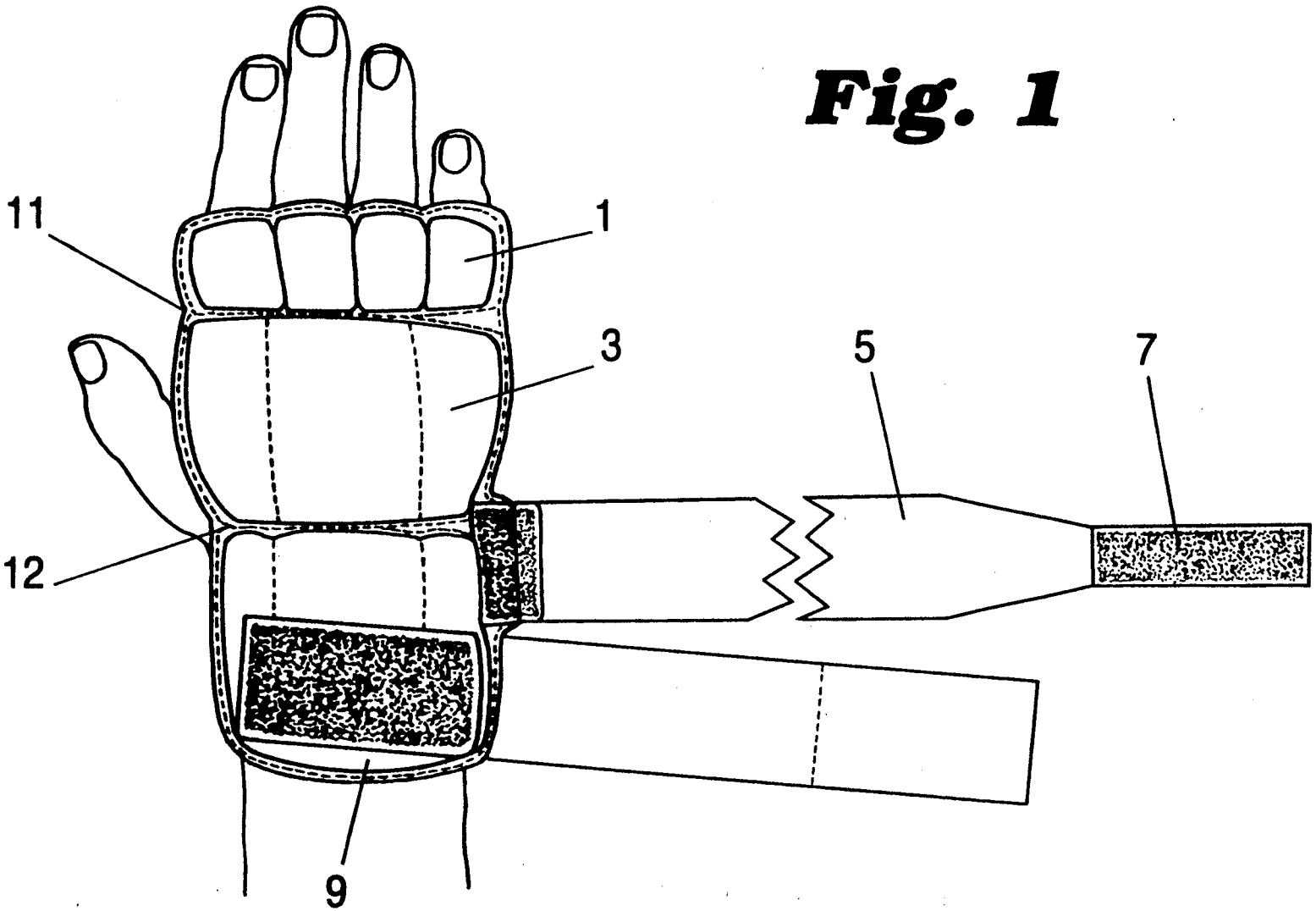
FIG. 1 is a back view of the right hand.
Figure 2:
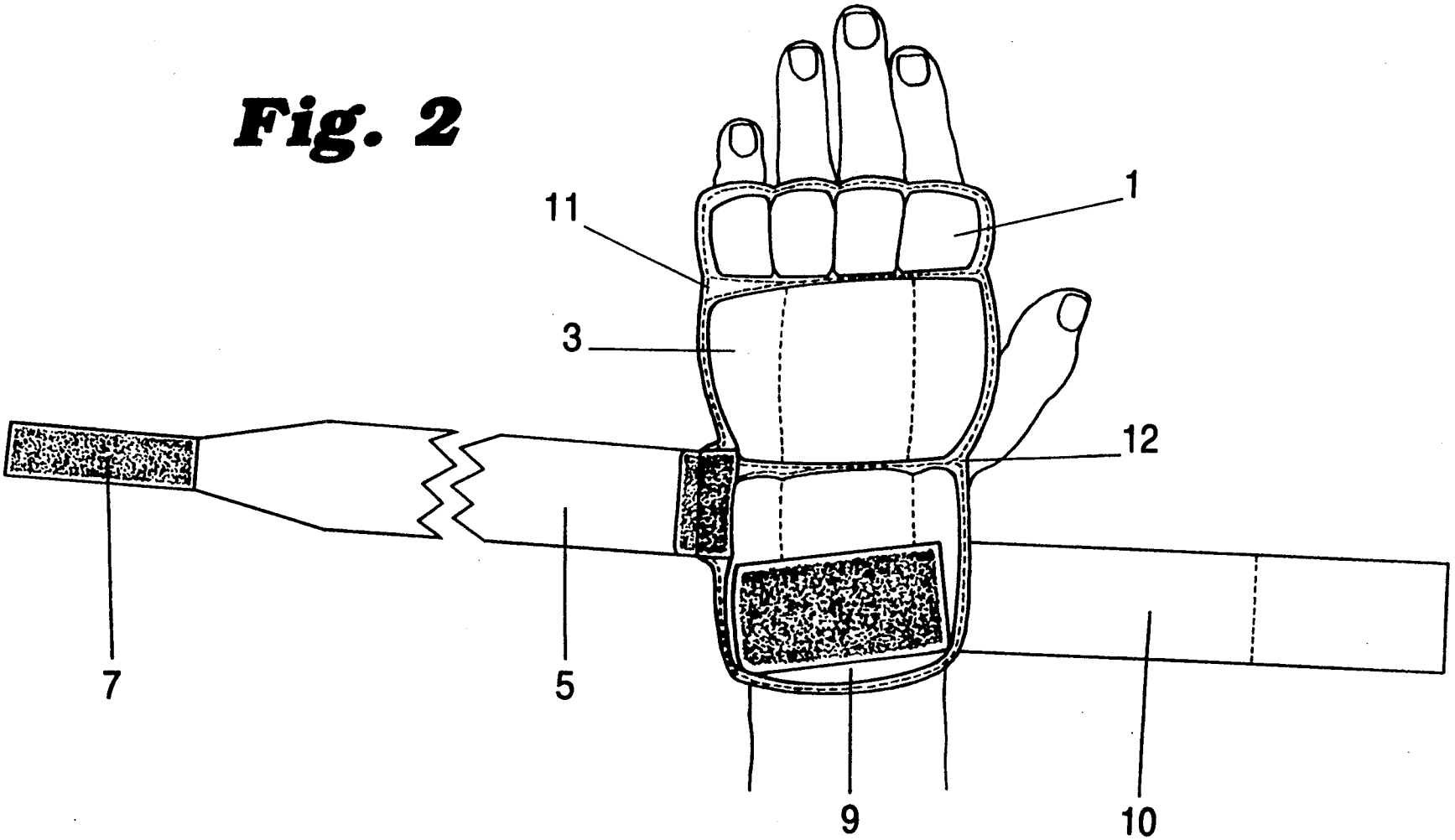
FIG. 2 is a back view of the left hand showing one embodiment of the all sports protective hand glove of the present invention on the hand of a user.
Figure 3:
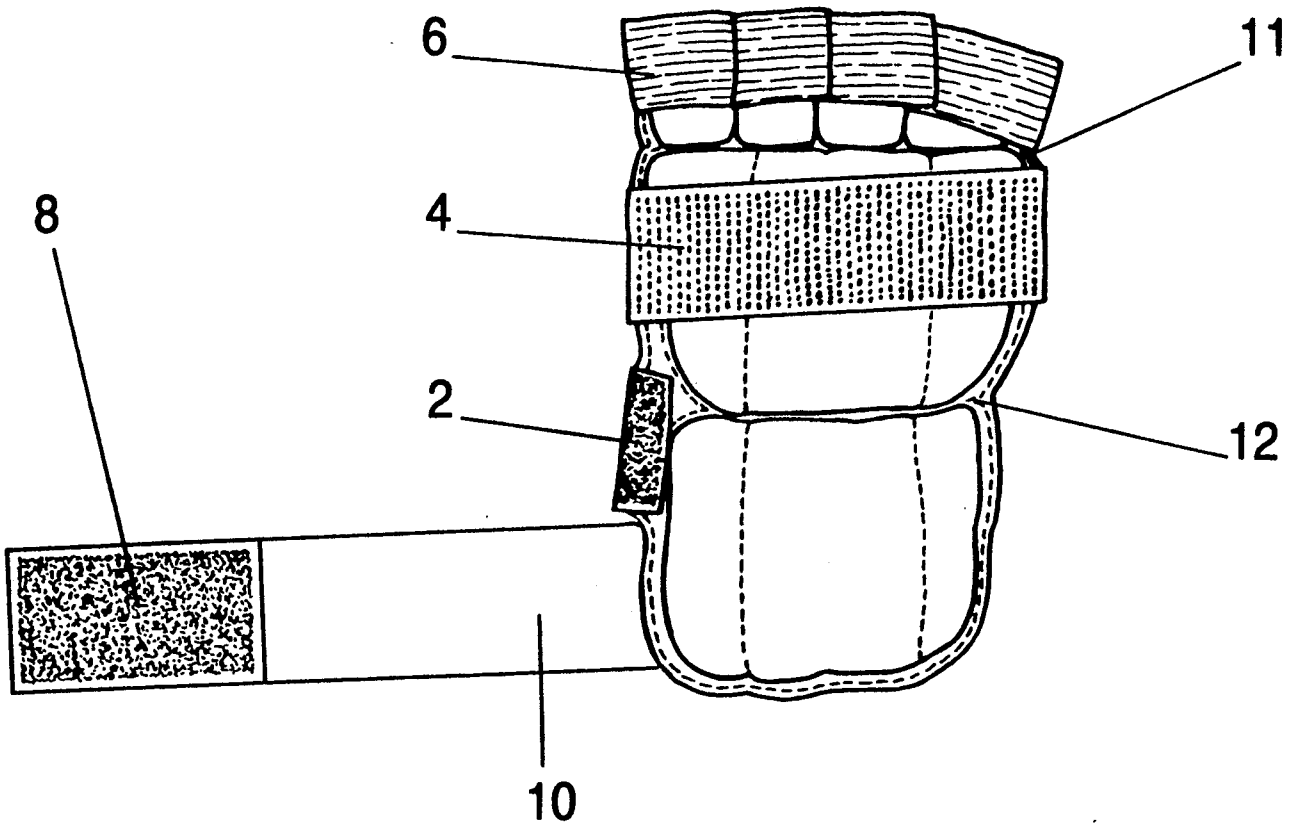
FIG. 3 is a front view of the right hand.
Figure 4:
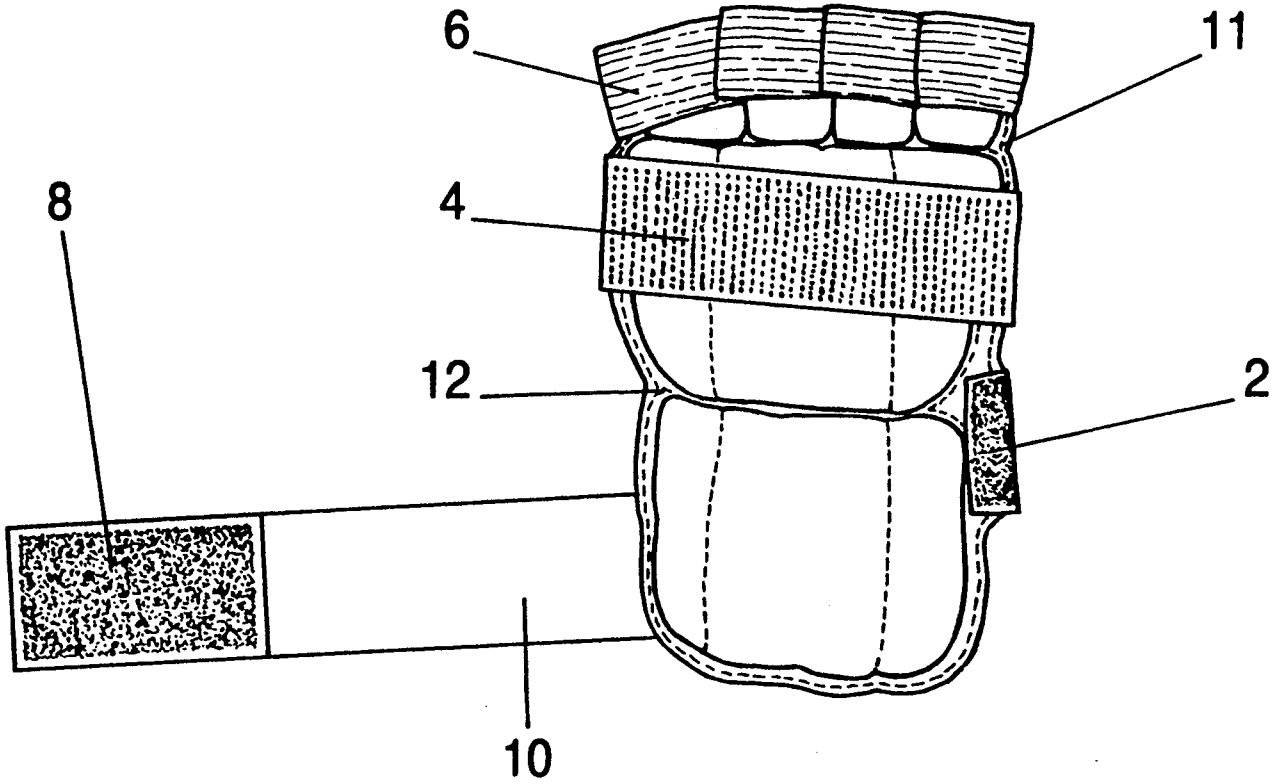
FIG. 4 is a front view of the left hand.

Referring to the drawings, a protective glove for all sports is shown attached in place on the hands in FIGS. 1 and 2 (right and left hand, respectively), and off the hand in FIGS. 3 and 4 (right hand and left hand respectively).

Referring to FIGS. 1 and 2, the glove includes a resilient hand pad contained in a casing of tough, pliable material such as leather, or cotton material. It provides protection for the fingers 1, back of the hand 3, and wrist 9. The hand pad covers the fingers 1, the back of the hand 3 and extends backward to a point to cover the wrist portion 9 of the back of the hand. Two hinged seams, one at the fingers 11 and the other at the wrist 12 are stitched through the pad and casing to form a flexing point that permits ready flexing of the fingers 11 and wrist 12 of the user.

The glove casing is formed by a top portion and a bottom portion stitched together along the side. In FIGS. 3 and 4, a 2-inch strip of hook and loop fastener 2 is attached to the wrist portion of the glove. In FIGS. 1 and 2, 85 inches of handwrap 5 is provided and may be attached to the glove at the hook and loop fastener strip 2. A pad of hook and loop fastener strip 7 is contained at the end of the 85 inches of handwrap 5 to secure the glove. The purpose of the 85 inches of handwrap 5 is to secure the thumb and stabalize the wrist. For FIGS. 1 and 2, protective padding for each finger 1 is stitched separately to provide protection and increased flexibility for the fingers and the knuckles. The first of two hinged seams 11 separates the finger pads 1 from the pad on the back of the hand 3. The first hinged seam 11 provides a flexing point for the fingers and the second hinged seam 12 provides a flexing point for the wrist. In FIGS. 3 and 4, the individual elastic finger loops 6 are attached to, and extend from the bottom of, the finger pads which the fingers slide through, allowing individual flexing of each finger, secure attachment of the glove and the ability of the user to make a fist or close the fingers. An elastic band 4 is attached to each side of the wrist portion of the glove to secure the glove at the palm. This elastic band allows the palm to remain unrestricted. A hook and loop fastener strap 10 is attached to the wrist portion of the glove and secures the wrist. It attaches to the glove with a hook and loop fastener strip.

The present invention provides a lightweight, strong, protective glove for all sports that permits finger, wrist and hand movement, flexing of fingers and wrist, unrestricted palms and thumbs and allows the user to make a tight fist or close the fingers. The two hinged seams, elastic finger loops, hook and loop fastener strap at the wrist, elastic band at the palm, and the 85 inches of handwrap provide protection for the fingers, knuckles, back of the hand and wrist and increase flexibility for the fingers and wrist and free the palm and thumb. With this invention, participants in all sports who are unable to wear the protective gloves currently marketed (because of the padding on the thumb and palm, the inability to make a fist and restricted movement of the fingers) will now have good protection for hands while maintaining the flexibility and movement required to play their sport.

Having thus described my invention, I claim:

1. A protective glove which can be worn in all sports, whether worn by itself or under another glove, comprising in combination:

a casing having a finger portion, a hand portion, and a wrist portion and made of tough, pliable material for covering the back of a wearer's hand and wrist and extending from the first finger knuckles to a location on a wearer's wrist, the casing having a first side in contact with the back of a wearer's hand, an exposed back side, and two lateral edges;

a plurality of individual elastic finger loops attached to the finger portion of the casing and extending from the first side of the casing for engagement by a wearer's fingers;

an elastic band attached to each lateral edge of the hand portion for securing the glove at the wearer's palm and leaving the palm unrestricted;

a plurality of finger pads individually stitched in said casing and extending over the first finger knuckles of a wearer;

a hand pad in said casing extending over the back of a wearer's hand;

a wrist pad in said casing and extending over a wearer's wrist;

two flexible hinge points, one at the juncture between the finger pads and the hand pad and the other at the juncture between the hand pad and the wrist pad, to accommodate finger flexing and wrist flexing;

a wrist strap extending from one lateral edge of the wrist portion of said casing and having quick connect means thereon;

quick connect means on the back of the wrist portion of said casing for connecting with said quick connect means on said wrist strap;

a two inch wide strip of hook and loop fastener material attached to one lateral edge of the wrist portion of said casing; and an 85 inch long handwrap having a quick connect means thereon for connection to the two inch wide hook and loop fastener strip and for wrapping about the wearer's hand and wrist to secure the thumb and stabilize the wrist.

2. A protective glove for all sports according to claim 1, wherein there is no padding over the thumb or palm of the wearer, leaving the palm and thumb unrestricted and allowing the hand of the wearer to flex and make a fist.

3. A protective glove for all sports according to claim 1, wherein individual stitching is provided for the hand pad and the wrist pad.

4. A protective glove for all sports according to claim 3, wherein the plurality of individual elastic finger loops comprises four elastic finger loops.

5. A protective glove for all sports according to claim 1, wherein the quick connect means on said wrist strap is a hook and loop fastener strip and said quick connect means on the back of the wrist portion of said casing is a hook and loop fastener strip.

6. A protective glove for all sports according to claim 1, wherein the quick connect means on the 85 inch long handwrap is a hook and loop fastener strip.

* * * * *